United States Patent [19]

Berney

[11] Patent Number: 4,856,674

[45] Date of Patent: Aug. 15, 1989

[54] COVER FOR PLASTIC CONTAINER

[75] Inventor: Sheldon Berney, Winnipeg, Canada

[73] Assignee: Reliance Products, Division of Larson Mardon Group Limited, Winnipeg, Canada

[21] Appl. No.: 235,118

[22] Filed: Aug. 23, 1988

[30] Foreign Application Priority Data

Nov. 3, 1987 [GB] United Kingdom ..... 8725738

[51] Int. Cl.[4] ..... B65D 51/22

[52] U.S. Cl. ..... 220/258; 220/306; 220/380; 206/508

[58] Field of Search ..... 220/258, 306, 308, 380; 206/508; 229/125.35

[56] References Cited

U.S. PATENT DOCUMENTS

| | | | |
|---|---|---|---|
| 1,746,847 | 2/1930 | Zoia | 206/508 X |
| 2,267,422 | 12/1941 | Rakowitzky | 220/258 X |
| 2,913,140 | 11/1959 | Vuillemenot | 206/508 X |
| 3,117,692 | 1/1964 | Carpenter et al. | 220/380 X |
| 3,307,739 | 3/1967 | Cloyd et al. | 206/508 |
| 3,480,177 | 11/1969 | Elliot | 220/380 X |
| 3,567,995 | 1/1971 | Mirasol, Jr. | 220/287 |
| 3,883,036 | 5/1975 | Mahaffy et al. | 220/306 |
| 3,892,351 | 7/1975 | Johnson et al. | 229/43 |
| 3,931,890 | 1/1976 | Davis | 206/508 |
| 4,044,941 | 8/1977 | Knudsen | 229/43 |
| 4,154,360 | 5/1979 | Smith | 220/258 |
| 4,209,107 | 6/1980 | Crisci | 220/306 |
| 4,296,871 | 10/1981 | Andersson | 220/306 |
| 4,380,304 | 4/1983 | Anderson | 220/306 |
| 4,407,426 | 10/1983 | McLaren et al. | 220/306 |
| 4,453,646 | 6/1984 | Harrild | 220/258 |
| 4,496,070 | 1/1985 | Lane, Jr. | 220/306 |
| 4,530,344 | 7/1985 | Iyengar et al. | 206/508 X |

*Primary Examiner*—Stephen Marcus
*Assistant Examiner*—Nova Stucker
*Attorney, Agent, or Firm*—Murray E. Thrift; Stanley G. Ade; Adrian D. Battison

[57] ABSTRACT

A container has a mouth with a peripheral lip and a membrane seal extending across the mouth of the container and sealed to the top of the lip. A lid for the container has a flat central panel positioned above the membrane, an intermediate panel extending upwardly from the periphery of the central panel to an outer panel that slopes downwardly to the outside where it meets a peripheral flange at an inside corner resting on the upper outer corner of the container lip. A snap-on flange is provided on the inside of the peripheral flange at a distance normally providing a gap between the bottom of the lip and the top of the snap-on flange. The lid is useful for large size containers that are intended to be stacked.

19 Claims, 1 Drawing Sheet

COVER FOR PLASTIC CONTAINER

FIELD OF THE INVENTION

The present invention relates to lids for large, stacking plastic containers and to the combination of such lids with containers where the container mouth is sealed with a membrane.

BACKGROUND

It is often useful to be able to stack containers for transportation or storage. This is particularly so with large, industrial sized containers, for example 5 gallon pails.

The weight of a large container, when filled, is quite significant and where filled containers are to be stacked, the lid design must be capable of taking the load of the containers stacked above and transmitting it to the containers below. The difficulties of designing a suitable container lid for this purpose are augmented where the container has a membrane sealed across its mouth before the lid is installed. The lid cannot be permitted to damage the membrane in any way The present invention is concerned with the provision of a container lid for large, stacking containers sealed with membranes.

SUMMARY

According to one aspect of the present invention there is provided a container lid comprising:

a peripheral flange adapted to surround an upper edge of a container;

an outer panel with an outer edge coincident with an upper edge of the peripheral flange and sloping upwardly and inwardly from the outer edge to an inner edge;

a flat center panel within the outer panel and positioned below the inner edge thereof; and an intermediate panel extending upwardly from the periphery of the center panel to the inner periphery of the outer panel.

According to another aspect of the present invention there is provided a combined container and lid wherein:

the container comprises a mouth with a peripheral lip thereabout, the lip having a bottom edge, and a membrane extending across the mouth of the container and sealed to the top of the peripheral lip; and the lid comprises:

a peripheral flange adapted to surround the lip of the container;

an outer panel having an outer edge extending along the top edge of the peripheral flange and sloping upwardly and inwardly from the outer edge to an inner edge;

a flat center panel within the outer panel and positioned below the inner edge of the outer panel; and an intermediate panel extending upwardly from the periphery of the center panel to the inner edge of the outer panel.

The flat center panel serves as the support for containers stacked on the lid. The intermediate panel around the center panel provides an adequate rim around the center panel to prevent the stacked container from sliding off the lid. Because the outer panel projects upwardly to the center, the center panel may be located above the inside corner between the outer panel and the peripheral flange, so that a membrane across the top of the lid will not be depressed by the center panel of the lid. In addition, the outer panel is free from engagement with the membrane along the top of the peripheral lip of the container and especially at the inside edge of the container mouth so that this area of the membrane is not subjected to a pinching or shearing action that could cause it to lose its integrity.

In preferred embodiments of the lid, the peripheral flange carries a coupling flange that is a snap fit over the peripheral lip of the container and that is spaced from the outer edge of the outer panel a distance greater than the vertical size of the peripheral lip. This allows some vertical play between the lid and the container, so that when the container is sealed hot, any bulging of the membrane can be accommodated.

BRIEF DESCRIPTION OF THE DRAWINGS

In the accompanying drawings which illustrate an exemplary embodiment of the present invention.

DETAILED DESCRIPTION

Figure 3:
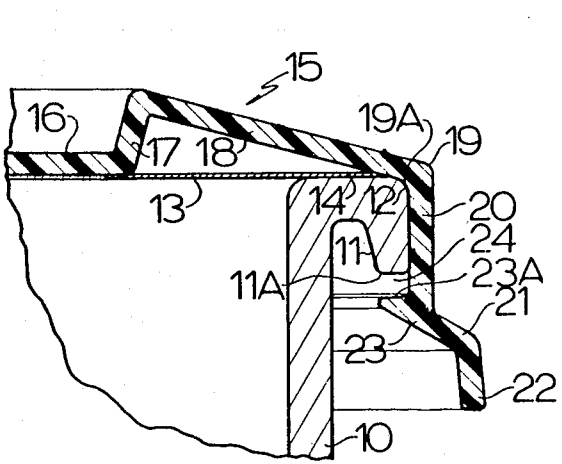
FIG. 3 is a detailed radial section showing the manner in which the lid is mounted on a container.
Figure 1:
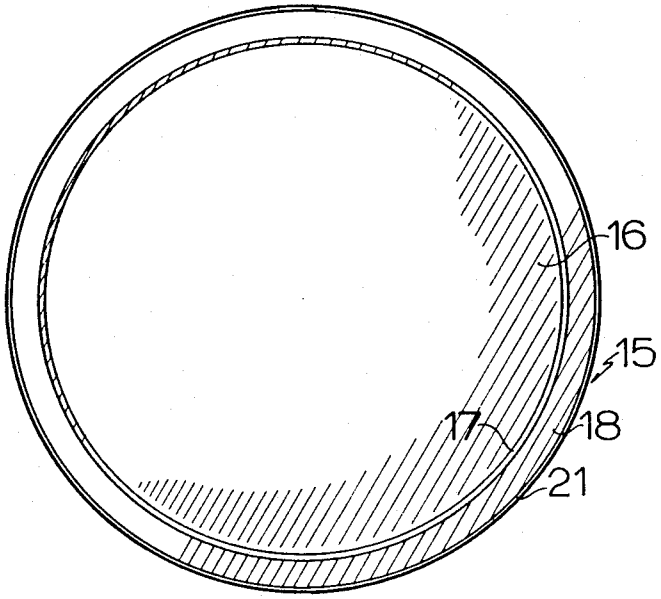
FIG. 1 is a plan view of a container lid according to the present invention.
Figure 2:
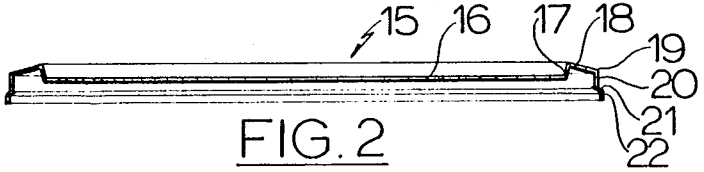
FIG. 2 is a diametral section or the container lid of FIG. 1.

Referring to the accompanying drawings, FIG. 3 illustrates a container 10 with a generally vertical, cylindrical wall with a peripheral lip 11 at the upper edge thereof. The lip is a flange with a first portion that extends radially from the upper edge or the container and a second portion projecting downwardly towards the base of the container and defining a lower face 11A. Where the two portions of the flange meet, the upper outer corner 12 is convexly rounded.

When the container is filled, a flexible membrane seal 13 is extended across the mouth of the container and is secured to the top surface 14 of the lip 11. The membrane is a laminated polyester/polyethylene material having a certain flexibility. It is heat sealed or induction sealed to the lip.

The lid 15 is illustrated in all three figures of the drawings.

The lid 15 has a flat, circular center panel 16 that is surrounded by a narrow, annular panel projecting up from the peripheral edge of the center panel 15 to the inner edge of an outer panel 18. The outer panel 18 slopes down to its outside edge 19, where it meets the top edge of a cylindrical flange 20. The flange 20 surrounds the container lip 11. The inside corner 19A between the flange 20 and the outer panel 18 is rounded and seats on the outer edge 12 of lip 11.

The flange 20 merges, at its lowermost edge, into an outwardly and downwardly inclined portion 21 which terminates in a substantially vertical lower portion 22 directed towards the bottom of the container 10.

Where the peripheral flange 20 meets the flange portion 21, there is an inwardly projecting connecting flange 23 with an upper face 23A that projects centrally, beneath the lower face 11A of the container lip 11. The bottom face of the flange 23 is an upwardly and inwardly sloping camming face continuing the lower face of flange portion 21. This camming face serves to engage the rounded edge 12 of lip 11 when the lid is being pressed onto a container to cam the locking flange 23 outwards to pass the lip 11.

A gap 24 is provided between the upper face 23A of the coupling flange 23 and the lower face 11A of the container lip 11. This allows the natural bulging of the membrane 13 that occurs when the container is sealed hot to raise the lid 15 so as to avoid over-stressing the membrane. On cooling, the membrane assumes the flat condition illustrated in FIG. 3.

The lid is constructed such that the bottom face of the flat central panel 16 is located vertically above the inside corner 19A between the outer panel 18 and the vertical peripheral flange 20. This prevents any unwanted deformation of the membrane 13 in the normal, at rest state.

When the containers are stacked, the base of an upper container will be seated on the flat center panel 16. The annular panel 17 surrounding the center panel serves to restrain lateral movements of the upper container. While the flat central panel 16 rests on the top surface of the membrane 13, it will be observed that the upwardly sloping outer panel 18 is entirely out of contact with the membrane in the area near the inside edge of the container wall and lip 11. Any stresses on the membrane 13 are thus minimized and are insufficient to cause the membrane to lose its integrity.

While one embodiment of the invention has been described in the foregoing, it is to be understood that other embodiments are possible within the scope of the present invention. Thus, while a circular container has been described, other embodiments may be non-circular in outline. Although the membrane 13 has been described as a polyester/polyethylene laminate, other materials may well be suitable, including laminates of metal foil and thermoplastics.

The center panel has been described as "flat". It is to be understood however, that low ridges, for example of 0.075 inches in height may be provided on the center panel in order to restrict the movement of a stacked container when the stacked container base is somewhat less than the inside diameter of the panel 17.

It is therefore to be understood that the present invention is to be construed as limited solely by the scope of the appended claims.

I claim:

1. A container lid comprising:

a peripheral flange adapted to surround an upper edge of a container;

an outer panel with an outer edge coincident with an upper edge of the peripheral flange and sloping upwardly and inwardly from the outer edge to an inner edge;

a circular flat center panel within the outer panel and positioned below the inner edge thereof; and an intermediate panel with an inner edge coincident with a peripheral edge of the flat center panel and extending upwardly and outwardly from the peripheral edge of the center panel to the inner edge of the outer panel.

2. A container lid according to claim 1 wherein the flat center panel is positioned above the inside corner between the peripheral flange and the outer panel.

3. A container lid according to claim 2 wherein the lid is circular.

4. A container lid according to claim 3 wherein the outer panel is a circular ring.

5. A container lid according to claim 4 wherein the center panel is circular.

6. A circular container lid comprising:

a cylindrical peripheral flange adapted to surround an upper edge of a container;

an outer panel comprising a circular ring with an outer edge coincident with an upper edge of the peripheral flange and sloping upwardly and inwardly from the outer edge to an inner edge;

a circular, flat center panel within the outer panel, positioned below the inner edge thereof and positioned above the inside corner between the peripheral flange and the outer panel; and an intermediate panel extending upwardly from the periphery of the center panel to the inner edge of the outer panel.

7. A container lid according to claim 6 including a coupling flange projecting inwardly from the peripheral flange, below the upper edge thereof.

8. A container lid according to claim 7 including a cam face on the bottom of the coupling flange, sloping upwardly towards the inside.

9. A container lid according to claim 8 including an outer lip on the peripheral flange, including a downwardly and outwardly sloping section and a terminal downwardly projecting section.

10. A combined container and lid wherein:

the container comprises a mouth with a peripheral lip thereabout, the lip having a bottom edge, and a membrane extending across the mouth of the container and sealed to the top of the peripheral lip; and the lid comprises:

a peripheral flange adapted to surround the lip of the container;

an outer panel having an outer edge extending along the top edge of the peripheral flange and sloping upwardly and inwardly from the outer edge to an inner edge;

a flat center panel within the outer panel and positioned below the inner edge of the outer panel; and an intermediate panel extending upwardly from the periphery of the center panel to the inner edge of the outer panel.

11. A combined container and lid according to claim 10 wherein the flat center panel is positioned above the inside corner between the peripheral flange and the outer panel.

12. A combined container and lid according to claim 11 wherein the lid is circular.

13. A combined container and lid according to claim 12 wherein the outer panel is a circular ring.

14. A combined container and lid according to claim 13 wherein the center panel is circular.

15. A combined container and lid according to claim 14 wherein the peripheral flange is cylindrical.

16. A combined container and lid according to claim 15 including a coupling flange projecting inwardly from the peripheral flange.

17. A combined container and lid according to claim 16 including a cam face on the bottom of the coupling flange sloping upwardly to the center, for engagement with the top of the peripheral lip of the container.

18. A combined container and lid according to claim 17 wherein the coupling flange has an upper face spaced from the inside corner between the peripheral flange and the outer top panel a distance greater than the vertical height of the peripheral lip of the container.

19. A combined container and lid according to claim 18 wherein the container lip comprises a flange with a first portion extending radially from the upper edge of the container and a second portion projecting towards the base of the container.

* * * * *